United States Patent [19]

Puleston

[11] Patent Number: 4,939,994

[45] Date of Patent: Jul. 10, 1990

[54] ENGRAVED PRINTING ROLLS

[75] Inventor: Sidney Puleston, Bridlington, England

[73] Assignee: Borden, Inc., Columbus, Ohio

[21] Appl. No.: 248,411

[22] Filed: Sep. 26, 1988

[30] Foreign Application Priority Data

Jan. 23, 1988 [GB] United Kingdom ..... 8801537

[51] Int. Cl.[5] ..... B41F 31/26; B41F 27/28

[52] U.S. Cl. ..... 101/348; 101/401.1

[58] Field of Search ..... 101/348, 350, 363, 170, 101/395, 401.1; 29/121.1, 121.2, 121.4, 121.5

[56] References Cited

U.S. PATENT DOCUMENTS 3,613,578 10/1971 Heurich .
4,155,766 5/1979 Hieber et al. .
4,301,583 11/1981 Poole .
4,601,242 7/1986 Fadner ..... 101/348
4,819,558 4/1989 Counard ..... 101/348

FOREIGN PATENT DOCUMENTS 2534192 1/1977 Fed. Rep. of Germany ..... 101/170
57-12697 1/1982 Japan ..... 101/170

*Primary Examiner*—J. Reed Fisher
*Attorney, Agent, or Firm*—Sidney W. Millard

[57] ABSTRACT

An engraved printing roll is formed by sequential indentations in the roll surface by a stylus. Each indentation is a diamond shape with a longer axis of each indentation overlapping each circumferentially adjacent indentation but the shorter axis not overlapping any other indentation.

8 Claims, 2 Drawing Sheets

ENGRAVED PRINTING ROLLS

FIELD OF THE INVENTION

This invention relates to printing rolls which are mechanically engraved to produce cells on the roll surface to receive printing ink as cell as the process of engraving the surface.

BACKGROUND OF THE INVENTION

Engraved printing rolls of the modern type are cylindrical in shape. Engraved on the cylindrical surface are a large number of cavities designed to hold ink which will be deposited on the desired printing medium, for example, paper, fabric, or plastic. The engraved cavities are called "cells" in the industry, and several hundred such cells or recesses are formed per linear inch; their depth may range from about 0.0015 inches to about 0.0008 inches.

The general operating characteristics of a printing operation of the type being considered in this invention are disclosed in the patent to Heurich, U.S. Pat. No. 3,613,578, and to the extent necessary for an understanding of the operation such is incorporated herein by reference.

The earliest form of engraved printing roll had a pattern of circular shaped cells. This produced a substantial "corner post" between the cells. In the industry a "corner post" is the area between cells where ink will not print, for example, with four cells in a square pattern the "corner post" is the flat area at the center of the square where no ink will be deposited.

Subsequently square shaped and hexagon shaped cells were developed. This obviously served to reduce the size of the corner post.

Another development included tri-helical grooving. This further reduced "corner post" problems but suffered the side effect of causing lateral ink migration with less control over the coating application.

So called "electronic engraving" (where a detector "reads" a black and white print of a design pattern to control a cutting stylus) can be programmed so that the stylus drags between one cell and the next to create a relatively shallow interconnecting channel; this aids the flow of ink. There is also known (see U.S. Pat. No. 4,301,583) a mechanical engraving process in which a shallow V-cut channel exists between adjacent cells.

A patent to Hieber et al (U.S. Pat. No. 4,155,766) shows a screen for engraving having interconnection of cells via channels which is another way the prior art has tried to improve the engraving procedure, to reduce the corner post and improve the resulting printing.

SUMMARY OF THE INVENTION

It is an object of the present invention to provide a new mechanical engraving process which provides printing rolls which have an extended print life while maintaining a given quality of printing.

In accordance with the present invention, a process of mechanically engraving a printing roll comprises the step of applying a cell-forming tool to the roll surface in a manner such that sequential indentations caused by the tool are overlapped to a minor degree taken in the direction of the circumference of the roll.

The preferred cross-sectional shape of the cells on the tool is that providing an elongated rhombus shape, that is, the axis of the rhombus measured in the direction of the circumference of the roll is larger than the other axis.

The cells formed may be of whole or truncated pyramid form.

The invention also provides a mechanically engraved roll having cells interconnected, in the direction of the circumference of the roll, at weirs.

BRIEF DESCRIPTION OF THE DRAWINGS

The invention will now be described further with reference to the accompanying drawings in which.

DESCRIPTION OF THE PREFERRED EMBODIMENT

A printing roll is conventionally cylindrical in shape. To carry ink on the roll it is customary to engrave thousands of minute cells or the roll surface. This invention is concerned with the shape, orientation and arrangement of these cells.

Figure 1:
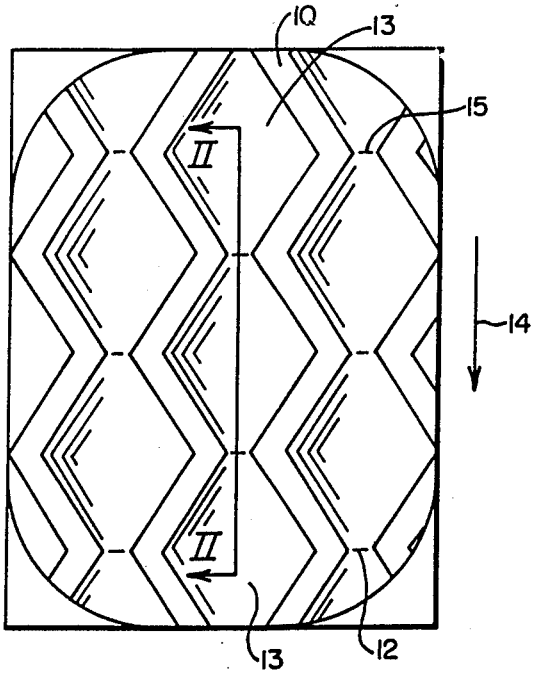
FIG. 1 is a fragmentary plan view of the engraved surface of a cylindrical printing roll, in accordance with the invention.

In FIG. 1 the lands or walls 1O between cells or indentations 13 are of zig-zag shape and of constant width. Any two adjacent zig-zags are mirror images of each other but they do not touch. Thereby, an opening 12 exists between cells 13 taken in the direction 14 of the circumference of the roll surface. The cells 13 are elongate diamond pyramidal in shape and form having a depth of in the range fifteen microns to ninety microns. They could also have a quadrilateral base. A form of weir 15, best seen in FIG. 2, exists between adjacent cells at the opening 12. The depth of the weir below the land or cell wall 10 is about ore-half the depth of the cell 13.

Figure 2:
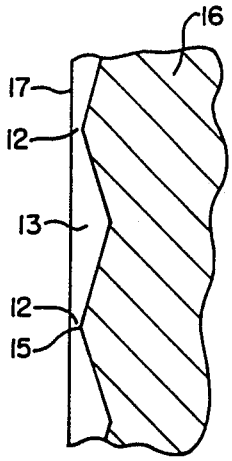
FIG. 2 is a section on the line II—II of FIG. 1.

In FIG. 2 a fraction of a cylindrical roll 16 is shown in section having at its surface the cells 13. Preferably the cells will number about sixty-five to two hundred per circumferential inch and a roughly corresponding number in a transverse direction. The surface 17 of the roll (which is swelt by a doctor blade in use to remove excess ink) is shown and this, of course, defines the cell wall areas 10.

Figure 3:
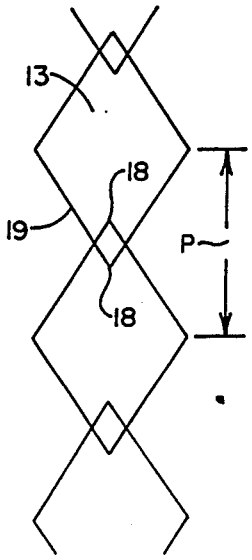
FIG. 3 is an explanatory diagram showing the formation of a master die.
Figure 4:
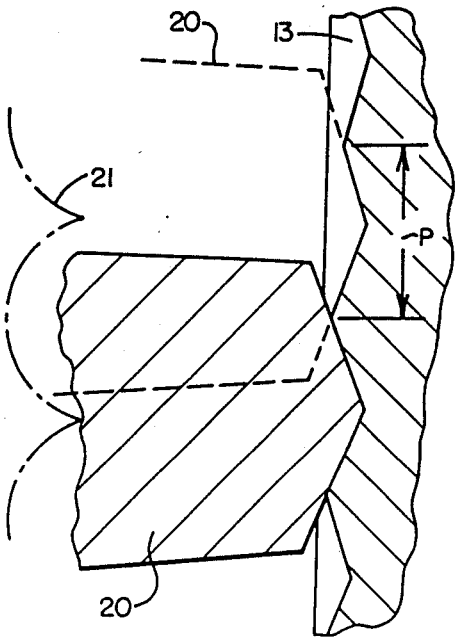
FIG. 4 is a section elevation supplementing FIG. 3.

In FIGS. 3 and 4 the pyramidal indentation making up each cell 13 is shown as an elongate diamond shape 19. As each indentation overlaps its adjacent indentations a form of circumferentially extending chain is created. Of course, the leading and trailing points 18 of the indentations become obliterated as each succeeding indentation is made and the eventual outline of the cells is completed - i.e. the diamond shaped cell aperture 13 as shown in FIG. 1. Indentations in the roll are made using a mill which is formed from a stylus or master die 20 made as shown in FIG. 4. The pitch between successive positions of the stylus or punch is represented by the letter "p". The path taken by the punch is shown by the chain line 21.

The deformation of the surface 17 of the roll by the stylus 20 during the formation of the cells 13 will obviously displace material in a radial direction. The means for maintaining or reforming the wall or land 10 at a uniform radial distance from the roll axis is known in the art and need not be described.

Figure 5A:
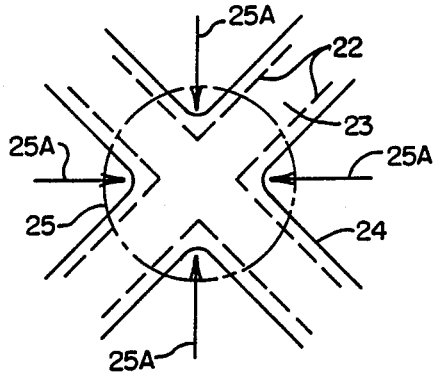
FIG. 5A PRIOR ART
FIGS. 5A and 5B show a portion of the surface of two prior art forms of roll and the effect of use.

FIG. 5A shows a prior art roll having initially isolated square cells 22 (dash lines) on a square matrix and having cell walls 23. With burnishing and wear smaller cells 24 (continuous lines) are formed with a somewhat irregular outline. At the same time a significantly enlarged "corner post" 25 (as represented by arrows 25A) is built up at the merger of the cell walls which is a serious impediment to any ink flow.

Figure 5B:
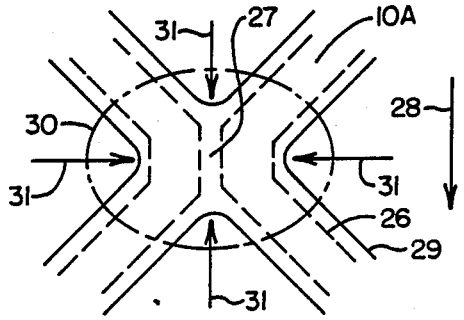
FIG. 5B PRIOR ART

In FIG. 5B another prior art arrangement is shown. In this figure the cells 26 (dash lines) are of approximately similar shape as in FIG. 5A initially but include narrow shallow connecting channels 27 between adjacent cells in the direction 28 of the circumference of the roll so that ink can flow between cells. As with the burnishing and wear mentioned in relation to FIG. 5A, the cell wall increases in width and the cell 26 decreases in size to a cell 29. When these channels 27 are blocked due to wear, to produce cells 29, a significant "corner post" 30 is again created (as represented by arrows 31).

Figure 6:
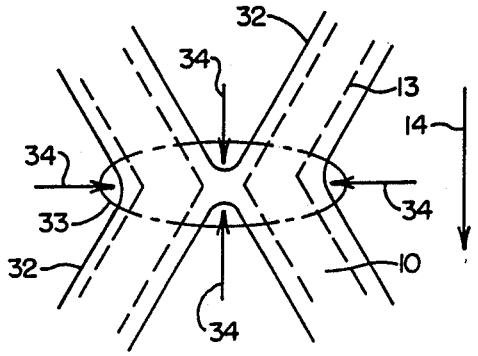
FIG. 6 shows a portion of the surface shown in FIG. 1 and the effect of use.

In FIG. 6, the arrangement of the present invention, the initial cells 13 are shown as dash-lines and the cell shape with burnishing and wear is shown as cells 32. Whilst the general burnishing and wear has occurred to the same extent as in FIGS. 5A and 5B, the "corner post" 33 (as represented by arrows 34) is not so excessive and ink can still flow easily across the corner post so that the quality of printing is not badly damaged. (Note particularly the small distance between the vertical arrows 34.)

Having thus described the invention in its preferred embodiment it will be clear to those having ordinary skill in the art that modifications may be made to the apparatus and the procedural steps without departing from the spirit of the invention. It is not intended that the words used to describe the invention in the specification nor the drawings illustrating the same be used in a limiting sense. Rather it is intended that the invention be limited only by the scope of the appended claims.

I claim:

1. A mechanically engraved cylindrical printing roll having cells interconnected at weirs in a line defining a circumference of the roll, to form a plurality of circumferentially extending chains around the roll, the walls defining each cell form an elongated rhombus outline with a major axis and a minor axis, said major axis having a length greater than the length of the minor axis, said major axis extending in the direction of said circumference of the roll, the corners of each circumferentially adjacent rhombus at both ends of the major axis overlapping to the extent that no rhombus includes an outline of a sharp point along said major axis, said circumference being coextensive with the major axis of each rhombus in said circumference, said weirs defining a sharp dividing line between cells, said weirs comprising the highest elevation on said circumference, said circumferential line substantially bisecting each weir, the depth of each of said cells increasing in both directions from the said weirs, each chain being spaced from adjacent chains by a zig-zag shaped wall of uniform elevation and width, each said wall extending circumferentially around the roll such that no wall contacts any other wall, and each wall is configured to be a mirror image of any next adjacent wall.

2. The printing roll of claim 5 wherein the cells are shaped as one of a whole or truncated pyramid form when viewed in cross-section.

3. The printing roll of claim 2 wherein each cell has a depth in the range of about 15–90 microns.

4. The printing roll of claim 3 wherein about 65 to 200 cells are formed per circumferential inch around the roll.

5. The printing roll of claim 1 wherein the depth of each weir below wall elevation is about one-half the depth of each cell.

6. The printing roll of claim 2 wherein the depth of each weir below wall elevation is about one-half the depth of each cell.

7. The printing roll of claim 3 wherein the depth of each weir below wall elevation is about one-half the depth of each cell.

8. The printing roll of claim 4 wherein the depth of each weir below wall elevation is about one-half the depth of each cell.

* * * * *